US008180234B2

(12) United States Patent
Takahashi et al.

(10) Patent No.: US 8,180,234 B2
(45) Date of Patent: May 15, 2012

(54) IMAGE FORMING APPARATUS WITH CONTROL CAUSING ISSUANCE OF PREDETERMINED INFORMATION BASED ON SHEET INFORMATION

(75) Inventors: Keita Takahashi, Abiko (JP); Takashi Fujimori, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 394 days.

(21) Appl. No.: 12/471,614

(22) Filed: May 26, 2009

(65) Prior Publication Data

US 2009/0295071 A1 Dec. 3, 2009

(30) Foreign Application Priority Data

May 30, 2008 (JP) ..... 2008-142837

(51) Int. Cl.
*G03G 15/00* (2006.01)
*G03G 21/00* (2006.01)

(52) U.S. Cl. ..... 399/45; 399/13; 399/81

(58) Field of Classification Search ..... 399/45, 399/81, 16, 23, 389, 391, 393, 13; 271/145, 271/162

See application file for complete search history.

(56) References Cited

U.S. PATENT DOCUMENTS

| | | | | |
|---|---|---|---|---|
| 4,796,035 | A | 1/1989 | Kawasaki et al. | 347/262 |
| 5,290,024 | A | 3/1994 | Takahashi | 271/122 |
| 5,474,287 | A | 12/1995 | Takahashi | 271/10.13 |
| 5,523,822 | A * | 6/1996 | Tsuda | 399/13 |
| 5,666,595 | A | 9/1997 | Sameshima et al. | 399/110 |
| 5,909,872 | A | 6/1999 | Takahashi | 271/116 |
| 6,311,039 | B1 | 10/2001 | Funamizu et al. | 399/394 |
| 6,397,035 | B2 | 5/2002 | Kataoka et al. | 399/388 |
| 6,751,425 | B2 | 6/2004 | Fujimori et al. | 399/69 |
| 6,793,425 | B2 | 9/2004 | Yoshikawa et al. | 400/624 |
| 6,952,541 | B2 | 10/2005 | Fujimori et al. | 399/70 |
| 6,996,349 | B2 * | 2/2006 | Ohta et al. | 399/45 |
| 7,050,751 | B2 | 5/2006 | Watanabe et al. | 399/391 |
| 7,058,329 | B2 | 6/2006 | Takahashi | 399/69 |
| 7,110,689 | B2 | 9/2006 | Takahashi | 399/68 |
| 7,120,371 | B2 | 10/2006 | Fujimori | 399/67 |
| 7,391,980 | B2 | 6/2008 | Sekiguchi et al. | 399/20 |
| 2003/0047864 | A1 * | 3/2003 | Nakamura et al. | 271/162 |
| 2004/0009003 | A1 * | 1/2004 | Kim | 399/81 |
| 2004/0257430 | A1 * | 12/2004 | Takahashi et al. | 399/16 X |
| 2006/0228152 | A1 * | 10/2006 | Kim | 271/145 X |

FOREIGN PATENT DOCUMENTS

| | | |
|---|---|---|
| JP | 2002-86860 | 3/2002 |
| JP | 2004-240585 | 8/2004 |
| JP | 2005-316336 | 11/2005 |

* cited by examiner

*Primary Examiner* — Sophia S Chen
(74) *Attorney, Agent, or Firm* — Fitzpatrick, Cella, Harper & Scinto

(57) ABSTRACT

An image forming apparatus has an informing portion that issues information; a storing portion that stores sheets; a sheet detecting portion that detects presence or absence of the sheets in the storing portion; a determination portion that determines a type of the sheets stored in the storing portion; and a control portion that causes the informing portion to issue a predetermined information in a case where the absence of the sheets is undetected by the sheet detecting portion and a change of the type of the sheets is determined by the determination portion.

6 Claims, 14 Drawing Sheets

IMAGE FORMING APPARATUS WITH CONTROL CAUSING ISSUANCE OF PREDETERMINED INFORMATION BASED ON SHEET INFORMATION

BACKGROUND OF THE INVENTION

1. Field of the Invention

The present invention relates to an image forming apparatus that performs a control corresponding to a type of sheets for use.

2. Description of the Related Art

Heretofore, as an image forming apparatus, there has been known an image input/output processing apparatus which is generally called as a digital multifunctional apparatus, has a copier function, a printer function, and further, a facsimile function and the like, and is capable of executing multiple image processing.

The image forming apparatus is capable of printing by using a variety of sheets such as plain paper, thick paper, coated paper, recycled paper, colored paper and a transparency (OHP sheet). The image forming apparatus has a construction capable of performing image formation under appropriate process conditions corresponding to types of the respective sheets.

For example, a printing apparatus described in Japanese Patent Application Laid-Open No. 2002-086860 decides, according to the selected type of sheets, offset data regarding a transfer voltage at the time of transferring toner images to the sheets. In such a way, an appropriate printing result is obtained.

In recent years, along with an increased variety of such recording mediums, not only such a sheet type as the plain paper but also a specific sheet brand is designated, and the printing can be performed under the optimum conditions for the sheet brand. A device controller that controls the image forming apparatus has a sheet database that stores attribute data of the sheets which the image forming apparatus supports. For example, an image forming apparatus described in Japanese Patent Application Laid-Open No. 2005-316336 is provided with a function to allow a user to set a variety of parameters for the image formation for each of the sheet types.

The parameters may include not only parameters such as a transfer condition and a fixation condition in image formation of an electrophotographic process, which are related to the image formation, but also a variety of parameters such as sheet feeding condition in a sheet feeding device and a condition for curl correction in a sheet delivering device.

There is a variety of methods regarding display of sheet information registered in the sheet database. For example, in the invention described in Japanese Patent Application Laid-Open No. 2004-240585, there is disclosed a technology of not displaying the registered sheet information entirely as a list but displaying the sheet information based on use conditions by the user. Supportable sheet types can be added to the database.

In the case where the user adds new sheets without removing sheets already stored in the sheet feeding device, and sets a sheet type different from a type of the already stored sheets, the following phenomena have occurred.

(A) Even if parameters corresponding to the already stored sheets are not suitable as image formation parameters of the newly set sheet type, image forming processing is carried out according to the designated parameters.

(B) In the case where an operator sets a different sheet type though the type of the newly added sheets is the same type as that of the already stored sheets, appropriate image formation is not performed.

SUMMARY OF THE INVENTION

The present invention provides an image forming apparatus that solves the above-mentioned problems.

The present invention provides an image forming apparatus which does not impair operability in setting parameters corresponding to sheets and sheet type setting, and is capable of preventing erroneous setting as much as possible.

The present invention further provides an image forming apparatus capable of preventing, as much as possible, image formation performed based on erroneous parameters.

Other objects of the present invention would be apparent from the following description that is based on the accompanying drawings, and from claims.

According to a first aspect of the present invention, there is provided an image forming apparatus, comprising: a informing portion that issues information; a storing portion that stores sheets; a sheet detecting portion that detects presence or absence of the sheets in the storing portion; a determination portion that determines a type of the sheets stored in the storing portion; and a control portion that causes the informing portion to issue a predetermined information in a case where the absence of the sheets is undetected by the sheet detecting portion and a change of the type of the sheets is determined by the determination portion.

Further features of the present invention become apparent from the following description of exemplary embodiment with reference to the attached drawings.

DESCRIPTION OF THE EMBODIMENT

An embodiment of the present invention will now be described in detail in accordance with the accompanying drawings.

<Construction of Image Forming System>

Figure 1:
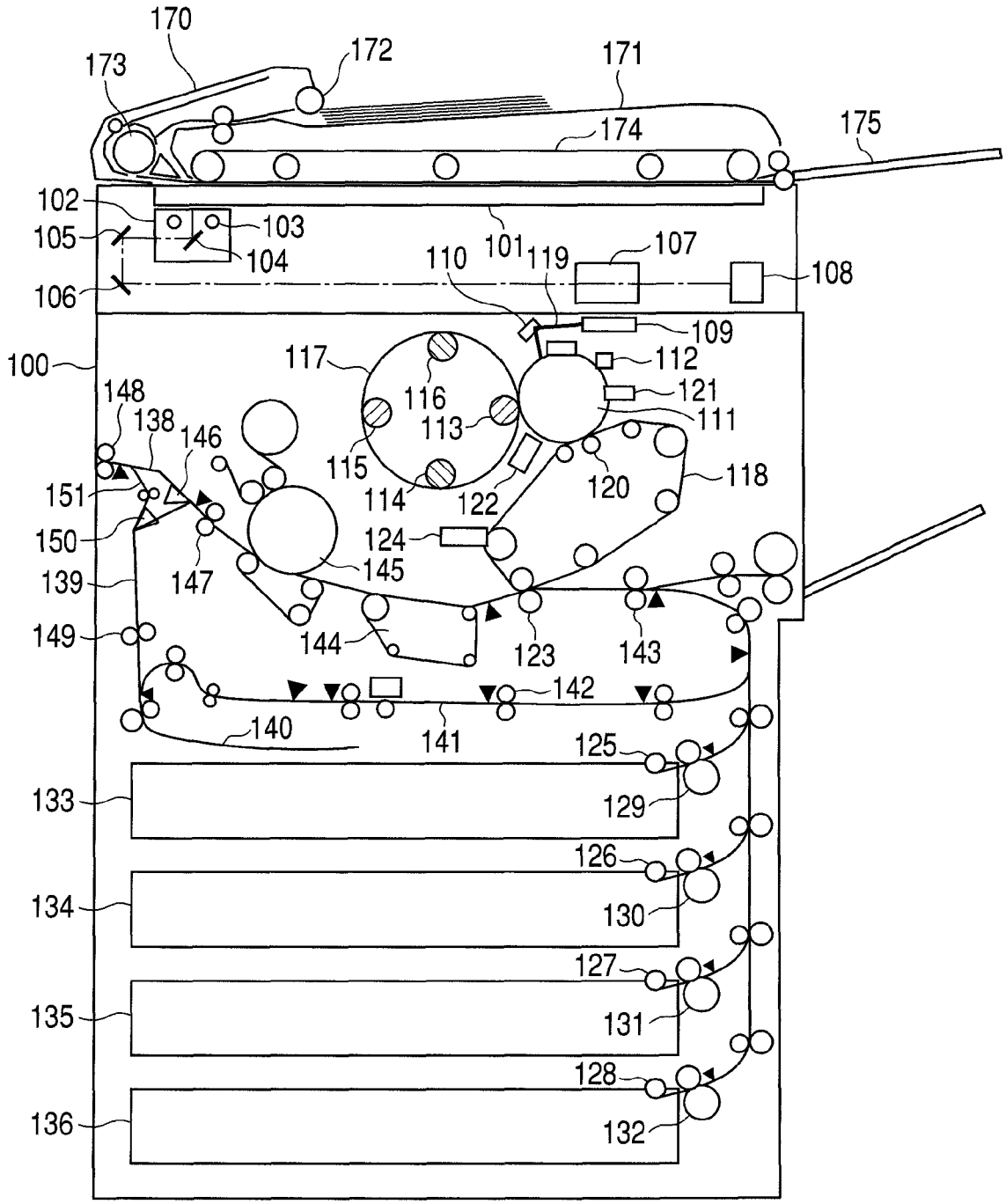
FIG. 1 is a cross-sectional view of a construction of an image forming apparatus.

An image forming system including an image forming apparatus according to the present invention is described. FIG. 1 illustrates the image forming system including the image forming apparatus according to the present invention.

In an image forming apparatus main body 100 of FIG. 1, an original table 101 is platen glass. A scanner 102 is formed of an original illumination lamp 103, a scanning mirror 104, and the like. The scanner 102 reciprocally scans in a left-and-right direction of FIG. 1 by a motor (not shown). While the reciprocal scanning, reflected light from the original is transmitted through a lens 107 via scanning mirrors 104 to 106, and an image of the original is formed on a CCD sensor in an image sensor portion 108.

An auto original feeder 170 (hereinafter, referred to as an ADF) automatically feeds the originals to a position at which the originals can be read by the scanner 102. An original stacking table 171 of the ADF can stack 100 originals at the maximum thereon. An original feed roller 172 is a roller for feeding the originals on the ADF. An original surface reverse roller 173 is a roller for reading both surfaces of the originals fed from the original feed roller 172.

An original conveyor belt 174 transports the originals, which are transported from the original feed roller 172 or the original surface reverse roller 173, onto the platen glass 101. The read originals are delivered to an original delivery port 175 by the original conveyor belt 174.

An exposure control portion 109 is formed of a laser, a polygon scanner, and the like. The exposure control portion 109 irradiates a photosensitive drum 111 with a laser beam 119 modulated based on an image signal converted into an electrical signal by the image sensor portion and performed predetermined image processing to be described later.

On the periphery of the photosensitive drum 111, there are placed a pre-exposure lamp 121 for deleting a potential on the photosensitive drum, and a primary charger 112 for allowing a wire which applies the potential to the photosensitive drum to perform corona discharge by applying a high voltage thereto. Developing devices 113 to 116 which develop, by toners, an electrostatic latent image formed on the photosensitive drum 111 are arranged. There are arranged a developing rotary unit 117 that moves the respective developing devices so that the developing devices can sequentially contact with the photosensitive drum, primary transfer rollers 120 which transfer the image developed on the photosensitive drum to an intermediate transfer member 118 that temporarily stores the image, and a cleaning device 122.

The photosensitive drum 111 rotates by a motor (not shown). After the photosensitive drum 111 is charged to have a desired potential by the primary charger 112, a laser beam 119 from the exposure control portion 109 is reflected by a folding mirror 110, and is irradiated onto the photosensitive drum 111. In such a way, the electrostatic latent image is formed on the photosensitive drum 111. With regard to the electrostatic latent image, the developing device 113 of a first color is moved by the developing rotary unit 117 so as to be brought into contact with the photosensitive drum 111, the toner in the developing device 113 is electrostatically attached thereonto, and the electrostatic latent image on the photosensitive drum 111 is developed by the toner of the first color, whereby a toner image is formed.

The toner image of the first color is transferred to the intermediate transfer member 118 by the primary transfer rollers 120. Then, by the developing rotary unit 117, the developing device 114 of a second color is brought into contact with the photosensitive drum. A toner image of the second color is formed in a similar way to the toner image of the first color. The toner image of the second color is transferred so as to be superimposed on the toner image of the first color, which has been transferred to the intermediate transfer member 118.

In a similar way, transfer of toner images of third and fourth colors is repeated, whereby a full-color developed image is formed on the intermediate transfer member 118.

A first sheet feeding portion 133, a second sheet feeding portion 134, a third sheet feeding portion 135, and a fourth sheet feeding portion 136 individually store sheets therein, and are made openable/closable with respect to the image forming apparatus. When the respective sheet feeding portions are opened with respect to (pulled out from) the image forming apparatus, the sheets can be refilled therein. The sheets fed from the first sheet feeding portion 133, the second sheet feeding portion 134, the third sheet feeding portion 135, or the fourth sheet feeding portion 136 by any of pickup rollers 125 to 128 are transported by any of sheet feed rollers 129 to 132 toward registration rollers 143. The stopped registration rollers 143 are driven so that such an unfixed toner image formed on the intermediate transfer member and each of the sheets can be aligned with each other, and coveys the sheet to secondary transfer rollers 123. A transferring bias is applied to the secondary transfer rollers 123, and the image is transferred onto the sheet. Thereafter, the sheet is transported by a conveyor belt 144.

Residual toners which have not been transferred to the sheet by the secondary transfer rollers 123 remain on the intermediate transfer member 118, and the residual toners are cleaned by an intermediate transfer member cleaner 124.

Residual toners on the photosensitive drum 111, which have not been transferred to the intermediate transfer member 118 by the primary transfer rollers 120, are cleaned by the cleaning device 122. Thereafter, residual charges on the photosensitive drum 111 are deleted by the pre-exposure lamp 121.

The sheet on which the toner images are transferred is transported to a fixing device 145 by the conveyor belt 144. The images are fixed by being pressurized and heated by the fixing device 145. Thereafter, the sheet is delivered to an outside of the image forming apparatus main body 100 by delivery rollers 147 and 148.

A delivery flapper 146 switches a conveying destination of the sheet to one of a delivery path 138 and a reverse path 139. At the time of both sides recording (double-sided copying) in which the images are formed on both surfaces of the sheet, the delivery flapper 146 shifts downward, and the sheet sent out from the delivery rollers 147 is conveyed to a both sides reversing conveyance path 140 via the reverse path 139. Thereafter, a transport direction is reversed, and the sheet is guided to a re-feed path 141 in a state of being turned inside out, and is transported to a position of re-feed rollers 142.

At the time of delivering the sheet from the image forming apparatus main body 100 while reversing the front surface and rear surface of the sheet, the delivery flapper 146 shifts upward, and the sheet sent out from the delivery rollers 147 is conveyed to the reverse path 139. When the sheet is transported by reverse rollers 149 to a position where a rear end of the sheet has passed through a reverse flapper 150, the reverse rollers 149 are reversed, whereby the sheet is guided to a delivery path 151 in a state of being tuned inside out, and is delivered to the outside by delivery rollers 148.

<Functions of Display and Operation Panel>

Figure 2:
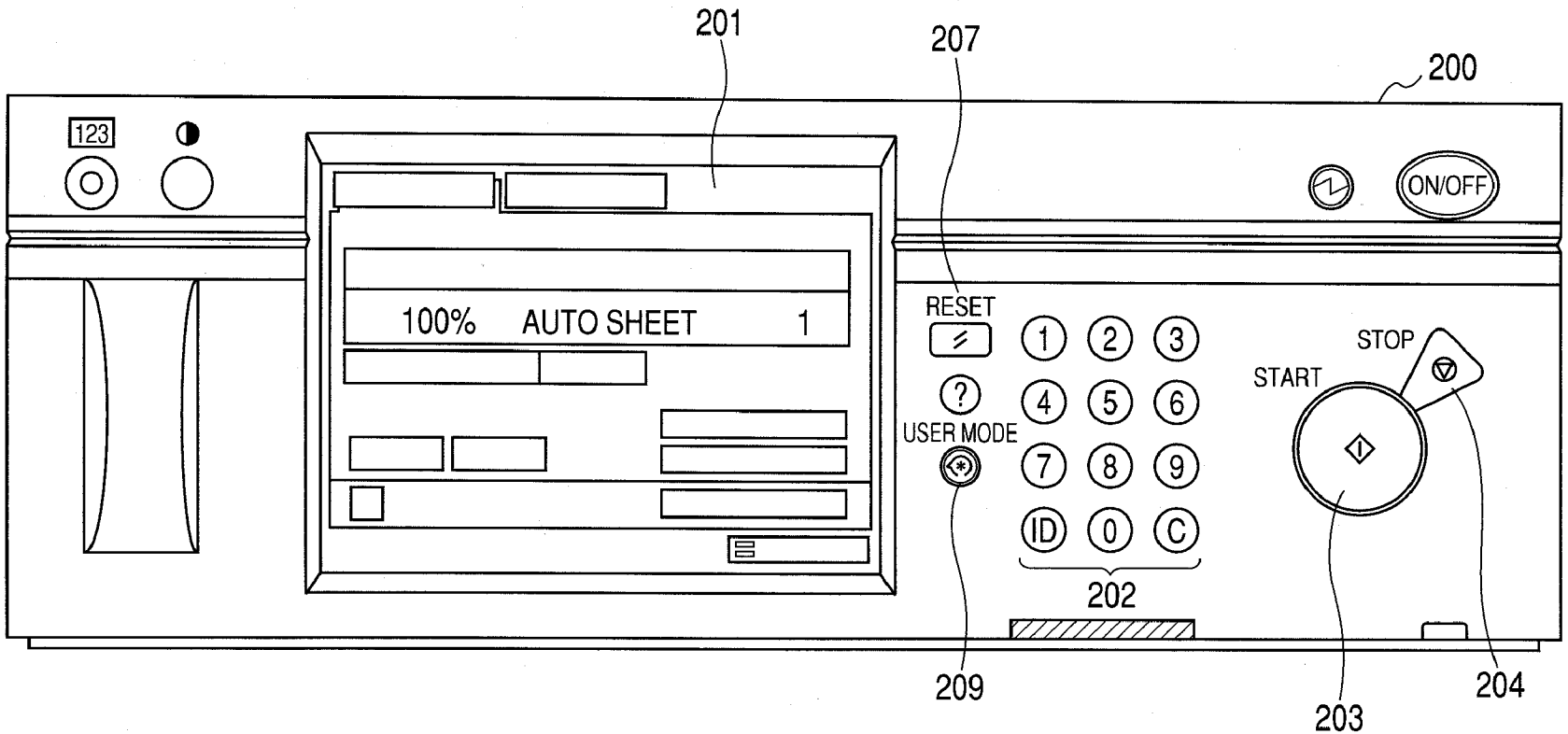
FIG. 2 illustrates a display and operation panel of the image forming apparatus.

Functions of a display and operation panel of the image forming apparatus of this embodiment are described. FIG. 2 illustrates a display and operation panel 200 of the image forming apparatus.

An LCD display portion 201 of a touch panel type performs mode setting such as selection of the sheet feeding portion of the image forming apparatus, status display, and the like. Ten keys 202 are formed of keys for inputting numbers from 0 to 9, and a clear key for returning the setting to a default value. A user mode key 209 is depressed in the case of setting default values of the respective functions of the image forming apparatus main body 100, and so on. A start key 203 is depressed at the time of executing a copy function, a scan function, and the like.

A stop key 204 is depressed at the time of desiring to discontinue jobs such as the copy function, a print function, and the scan function.

A reset key 207 is a key for returning the set mode to a predetermined standard mode.

By means of the display and operation panel 200, a user can set a variety of parameters of the image forming apparatus, and can operate the image forming apparatus.

<Circuit Configuration of Image Forming Apparatus>

A control configuration of the image forming apparatus in this embodiment is described below.

Figure 3:
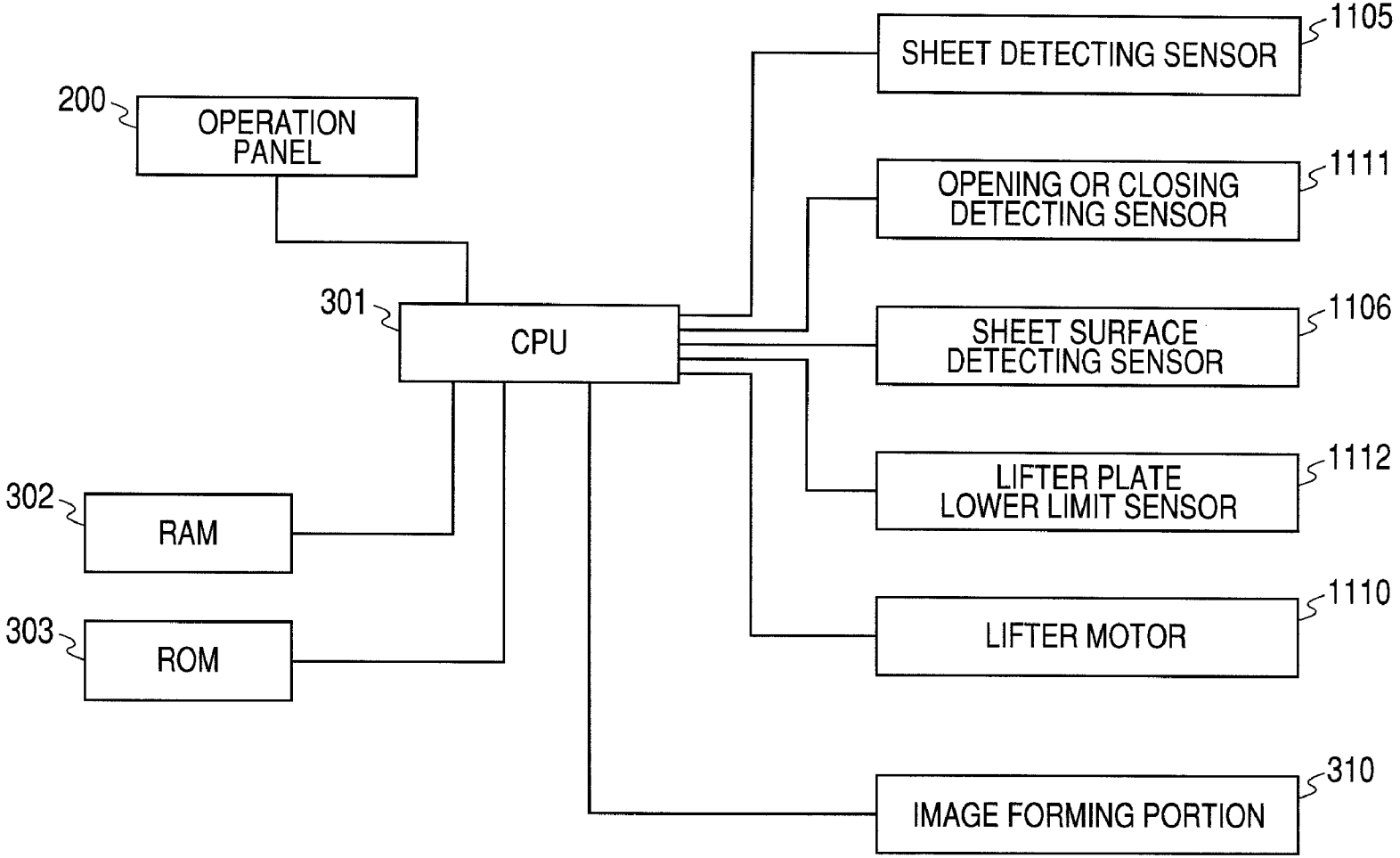
FIG. 3 is a block diagram of a schematic construction of the image forming apparatus.

FIG. 3 is a circuit block diagram illustrating a construction relating to the setting of the sheet type and to the sheet feeding portions of the image forming apparatus main body 100. In FIG. 3, a CPU 301 is a control portion that controls the entirety of the image forming apparatus. A RAM 302 is used as a work area of the CPU 301, and is backed up by a battery. A ROM 303 stores programs executed by the CPU 301, and a variety of data. A sheet detecting sensor 1105 detects whether or not there are sheets in the sheet feeding portion. An opening or closing detecting sensor 1111 detects an opening or closing state of the sheet feeding portion with respect to the image forming apparatus. A sheet surface detecting sensor 1106 detects an uppermost surface of the sheets stacked in the sheet feeding portion. A lifter plate lower limit sensor 1112 detects whether or not a lifter plate in the sheet feeding portion, which is described later, is located at a lower limit position thereof. A lifter motor 1110 raises the lifter plate. An image forming portion 310 includes such varieties of drive portions and sensors in the image forming apparatus.

<Structure of Sheet Feeding Portions>

Structures and functions of the sheet feeding portions are described.

Figure 4:
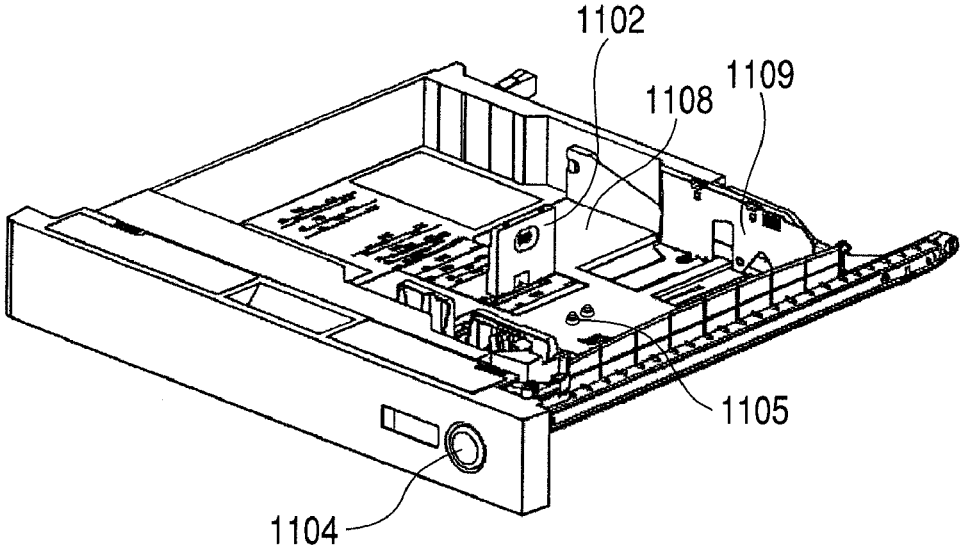
FIG. 4 is a perspective view of a sheet feeding portion of the image forming apparatus.

FIG. 4 is a perspective view of the sheet feeding portion 133. Constructions of the sheet feeding portions 133 to 136 are the same, and accordingly, only the sheet feeding portion 133 is described. A rear end regulation plate 1102 partially regulates a substantial center portion of a side surface at a rear end of the bundle of the stacked sheets, and regulates a position of the sheets. A side regulation plate 1109 regulates a lateral direction which is perpendicular to the transport direction of the sheets. A middle plate 1108 supports a bottom surface of the stacked bundle of the sheets.

The sheet detecting sensor 1105 is a reflection type sensor that detects whether or not there are sheets in the sheet feeding portion. Specifically, the sheet detecting sensor 1105 functions as sheet detecting means of the present invention. An opening button 1104 opens (pulls out) the sheet feeding portion. When the opening button 1104 is depressed, a locking mechanism (not shown) between the sheet feeding portion and the image forming apparatus is unlocked, whereby the sheet feeding portion can be pulled out. The opening or closing detecting sensor 1111 detects, as the closing state, a state in which the sheet feeding portion 133 is mounted on the image forming apparatus main body 100 in state of being capable of feeding the sheets. The opening button 1104 is depressed, whereby the opening or closing detecting sensor 1111 detects, as the opening state, a state in which the sheet feeding portion 133 is pulled out from the image forming apparatus main body 100.

Figure 5:
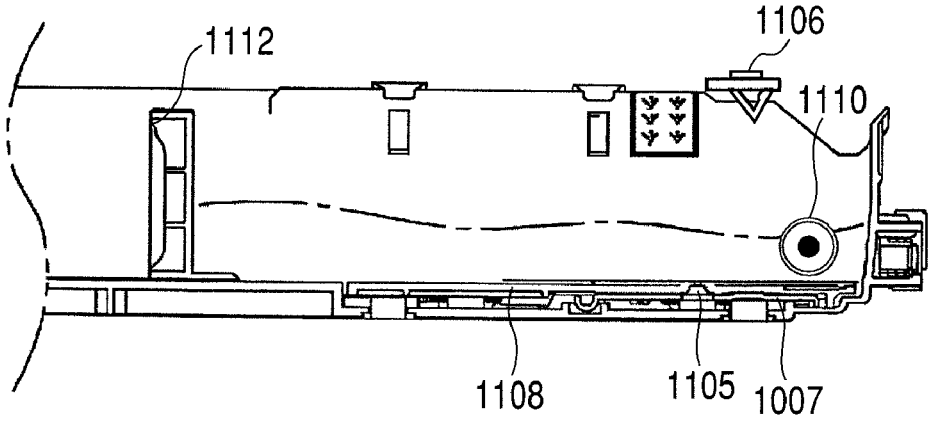
FIG. 5 is a vertical cross-sectional view of the sheet feeding portion of the image forming apparatus.

FIG. 5 is a vertical cross-sectional view of the sheet feeding portion 133. A lifter plate 1107 pushes up the middle plate 1108, and rises by the lifter motor 1110 rotating. When the middle plate rises, and the uppermost surface of the sheet bundle is detected by the sheet surface detecting sensor 1106, the rotation of the lift motor 1110 is stopped. The sheet detecting sensor 1105 is supported by the lifter plate 1107, and rises in a similar way to the lifter plate 1107 when the lifter plate rises. The lifter motor 1110 uses a pulse motor, and the CPU 301 counts pulses for driving the pulse motor, whereby a stacking amount of the sheets is detected. At the time of lowering the lifter plate, the lifter motor 1110 specifies the lower limit position thereof while detecting by the lifter plate lower limit sensor 1112.

Figure 6:
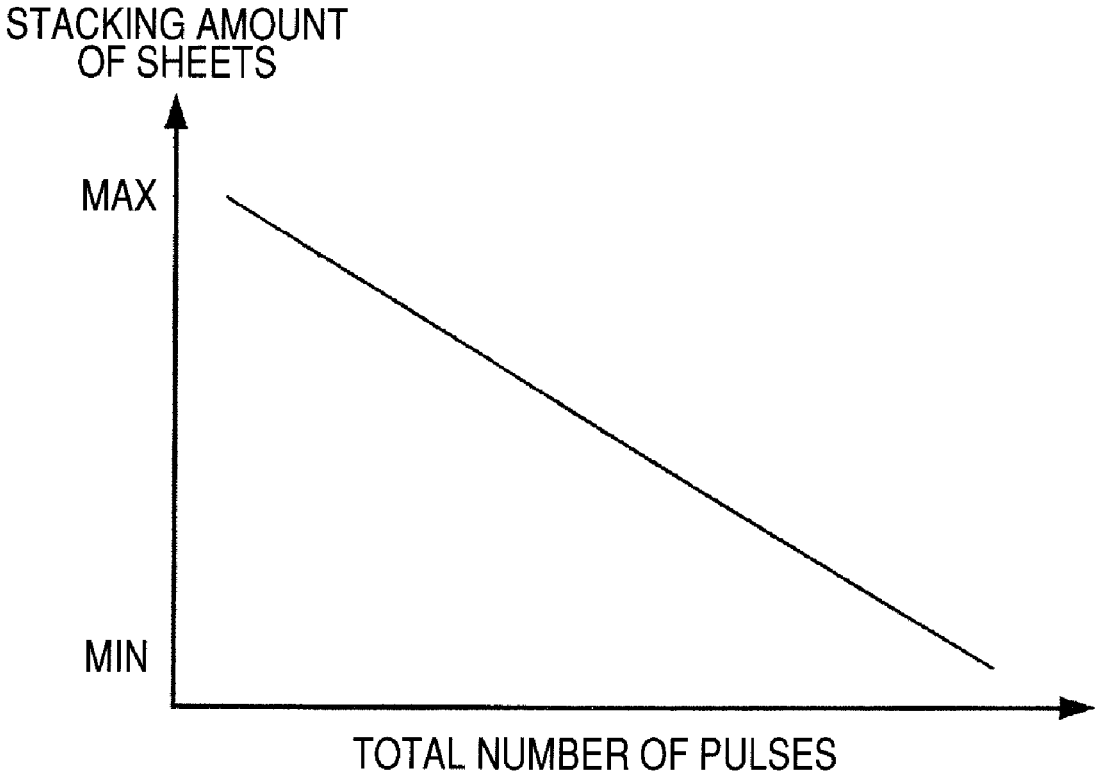
FIG. 6 illustrates a relationship between the number of drive pulses of a lifter motor and a stacking amount of sheets.

FIG. 6 is a diagram illustrating a relationship between the number of drive pulses of the lifter motor 1110 and the stacking amount of sheets onto the sheet feeding portion. The drive pulses are supplied to the lifter motor 1110 from a state in which the lifter plate 1107 is located at the lower limit position, and the amount of sheets in the sheet feeding portion is detected based on the number of pulses at the time when the sheet surface detecting sensor 1106 detects the sheet. Data representing the relationship of FIG. 6 is stored in the ROM 303.

As the sheets are being fed by execution of the image formation, the uppermost surface of the sheets is lowered. When the sheet surface detecting sensor 1106 stops to detect the sheets, the lifter motor is driven until the sheet surface detecting sensor 1106 detects the sheets again, and the counted number of drive pulses is also increased. Hence, the stacking amount of sheets can be determined even during the image forming operation.

<Setting of Sheet Type>

A procedure of setting the sheet type (sheet setting procedure) by the display and operation panel 200 is described.

Figure 7:
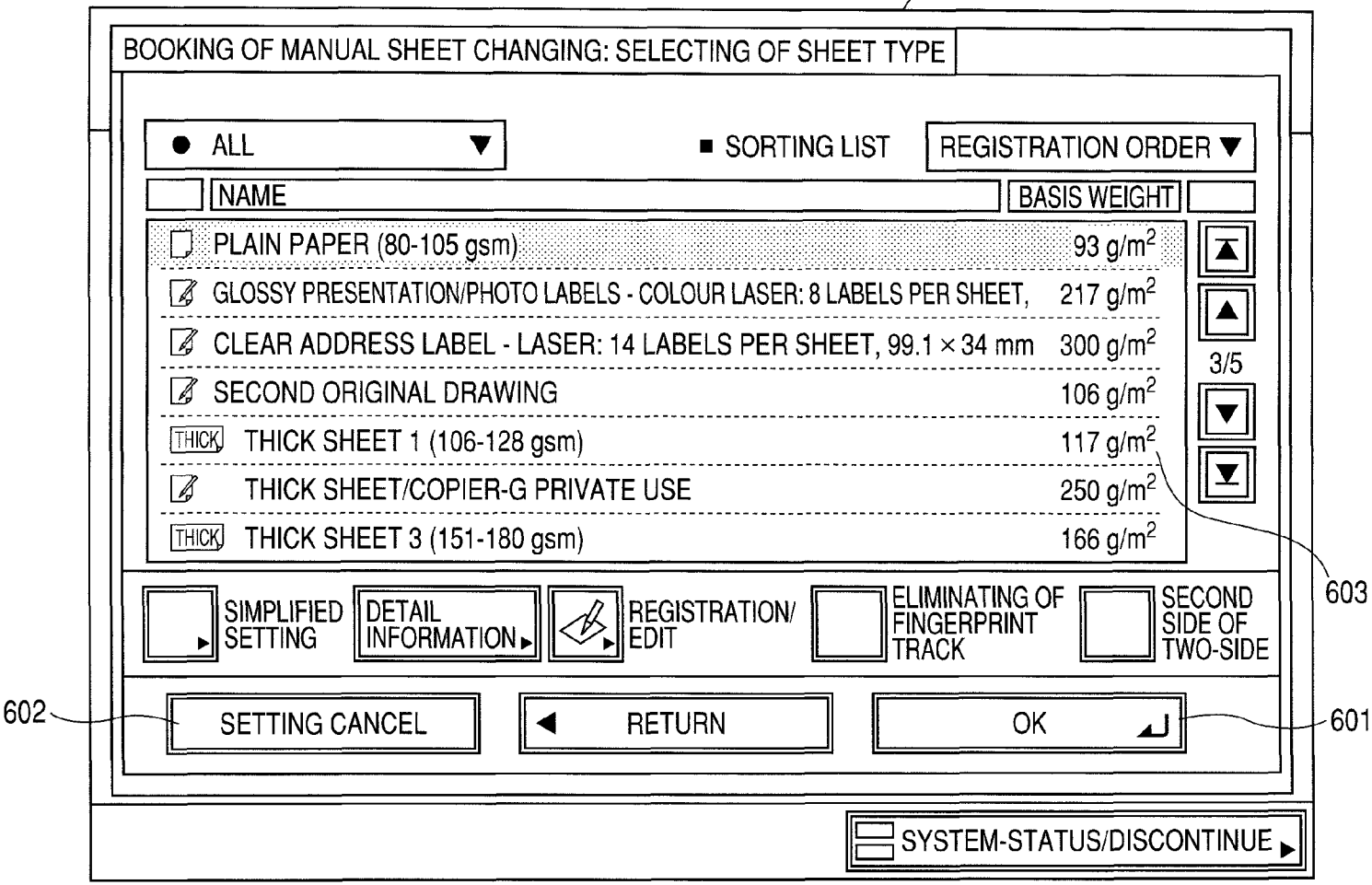
FIG. 7 illustrates a screen for setting sheet types.

FIG. 7 is a screen for setting the sheet type. The user selects a candidate of the sheet type by depressing a column of the sheet type, which coincides with the sheets stored in each of the sheet feeding portions 133 to 136, from a list 603 of the sheet types. An OK key 601 is a key for determining the selection of the sheet type after the candidate is selected in the list 603. A cancel key 602 is depressed in the case of cancelling the selection of the candidate.

The screen for the sheet setting is displayed by depressing a predetermined key on the display and operation panel 200. However, the screen may be automatically displayed in response to that the sheets are supplied to any of the sheet feeding portions 133 to 136.

<Sensing of Sheet Amount>

A procedure of detecting a sheet amount (stacking amount detecting procedure) in the image forming apparatus of this embodiment is described.

Figure 8:
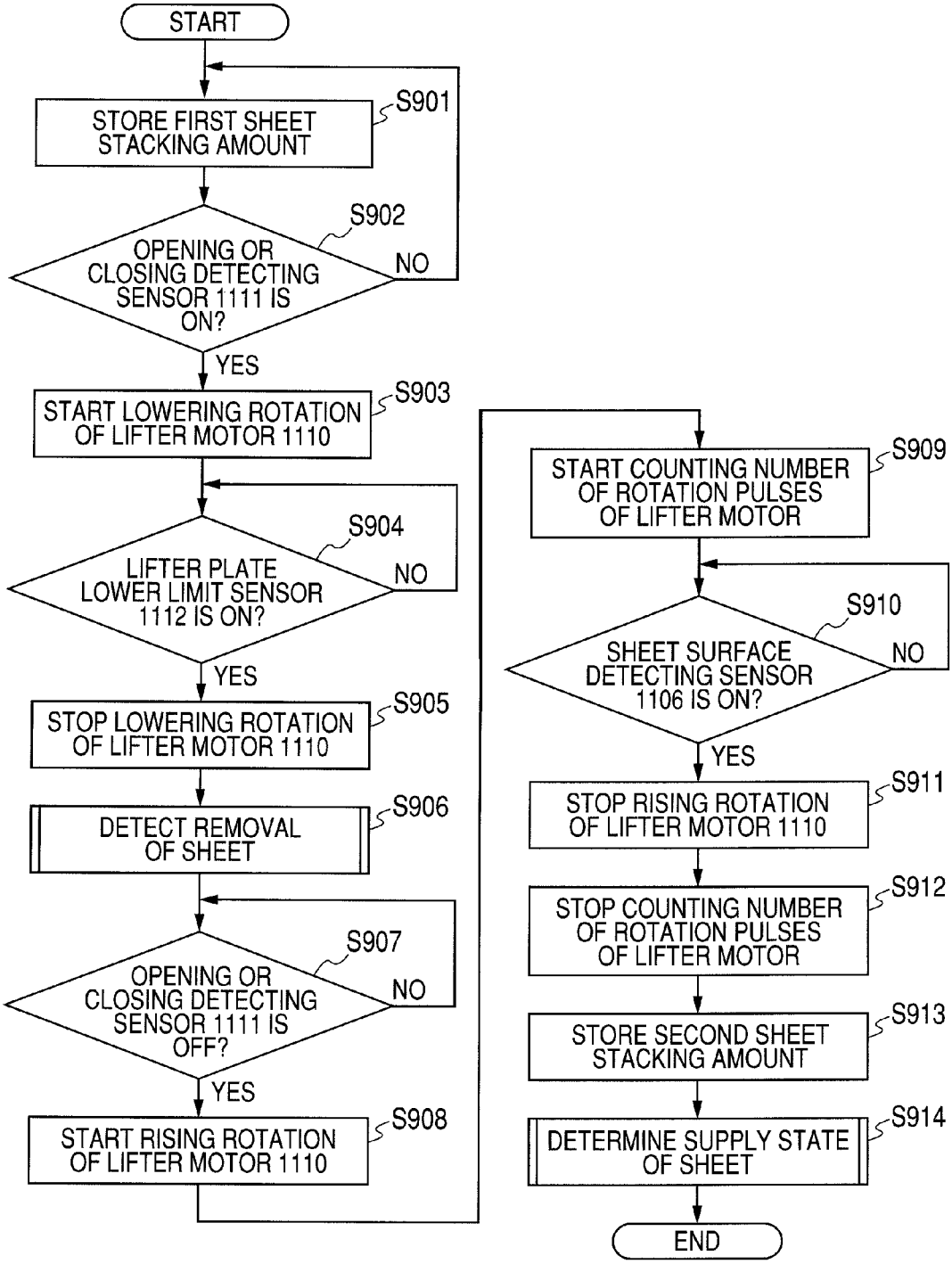
FIG. 8 is a flowchart of detecting processing for the stacking amount of sheets when the sheets are supplied to the sheet feeding portion.

FIG. 8 is a detecting flowchart of the sheet amount in the case where the sheets are stored in any of the sheet feeding portions 133 to 136, and the detecting flowchart is executed by the CPU 301 based on the program stored in the ROM 303. Note that the description is made for the sheet feeding portion 133 in this flowchart. The CPU 301 detects the stacking amount of the sheets in the sheet feeding portion 133 based on the number of drive pulses of the lifter motors 1110, and stores the detected stacking amount as a first sheet stacking amount in the RAM 302 (S901). The first sheet stacking amount is equivalent to a stacking amount of the sheets before the supply thereof. The CPU 301 determines whether or not the sheet feeding portion 133 turns to the opening state based on an output of the opening or closing detecting sensor 1111 (S902). If the sheet feeding portion 133 is not opened, then the procedure returns to S901, and the detecting of the sheet stacking amount is repeated. At this time, if the image formation is performed, and the amount of sheets is reduced, the first sheet stacking amount is updated since the lifter motor 1110 is driven. When the sheet feeding portion 133 is opened, the CPU 301 starts to rotate the lifter motor 1110 in a direction of lowering the lifter plate 1107 in order to lower the lifter plate 1107 (S903). Next, the CPU 301 monitors the lifter plate lower limit sensor 1112, and determines whether or not the lifter plate 1107 is lowered to the lower limit position (S904). Upon detecting the lower limit position, the CPU 301 stops rotating the lifter motor 1110 in S905 (S905). Thereafter, the CPU 301 detects removal of the sheets in the sheet feeding portion 133 (S906). Details of such detecting of the sheet removal are described later.

The CPU 301 monitors the opening or closing detecting sensor 1111 again, and determines that the sheet feeding portion 133 is closed again (S907). When the sheet feeding portion 133 is closed, the CPU 301 starts to rotate the lifter motor 1110 in a rising direction (S908). At this time, the CPU 301 starts to count the number of drive pulses of the lifter motor 1110 (S909). The CPU 301 waits for the sheet surface detecting sensor 1106 to be turned on (S910). When the sheet surface detecting sensor 1106 is turned on, the CPU 301 stops rotating the lifter motor 1110 (S911), stops counting the number of pulses (S912), and stores the counted number of pulses as a second sheet stacking amount (S913). The second sheet stacking amount is equivalent to a stacking amount of the sheets after the supply thereof.

Next, the CPU 301 determines a supply state (hereinafter, referred to as sheet status) of the sheets in the sheet feeding portion 133 (S914). Details of the determination of the sheet status are described later.

<Detecting of Sheet Removal>

A procedure of detecting the sheet removal is described below.

Figure 9:
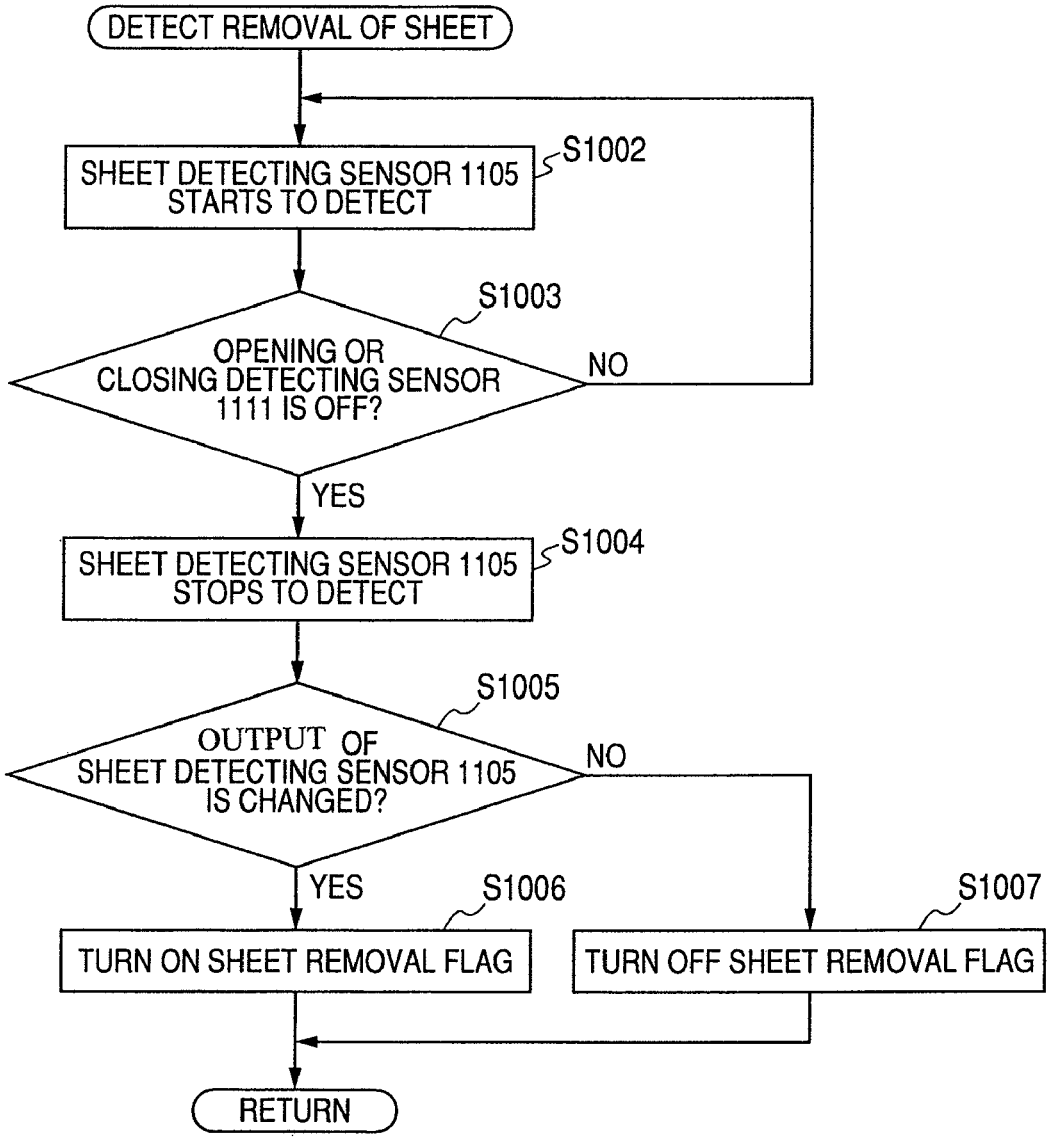
FIG. 9 is a flowchart of detecting processing for removal of the sheets from the sheet feeding portion.

FIG. 9 is a flowchart of detecting the sheet removal in the sheet feeding portion 133 in S906 of FIG. 8. The CPU 301 starts to detect, by the sheet detecting sensor 1105, existence or nonexistence of sheets (S1002), and determines whether or not the opening or closing detecting sensor 1111 is turned off (S1003). If the opening or closing detecting sensor 1111 is turned off, the CPU 301 ends the detecting, by the sheet sensing sensor 1105, existence or nonexistence (S1004). Then, the CPU 301 determines whether or not an output of the sheet detecting sensor 1105 is changed from existence of sheets to nonexistence of sheets. Specifically, the CPU 301 determines whether or not all of the sheets are removed until the sheet feeding portion 133 is closed after the sheet feeding portion 133 is opened. In the case where there is the change, that is, where all of the sheets are removed until the sheet feeding portion 133 is closed after the sheet feeding portion 133 is opened, the CPU 301 turns on a sheet removal flag (S1006). In the case where there is not the change, that is, where the sheets are not removed, the CPU 301 turns off the sheet removal flag (S1007).

<Determination of Sheet Status when Sheet Feeding Portion is Opened and Closed>

Details of S914 of FIG. 8 are described.

Figure 10:
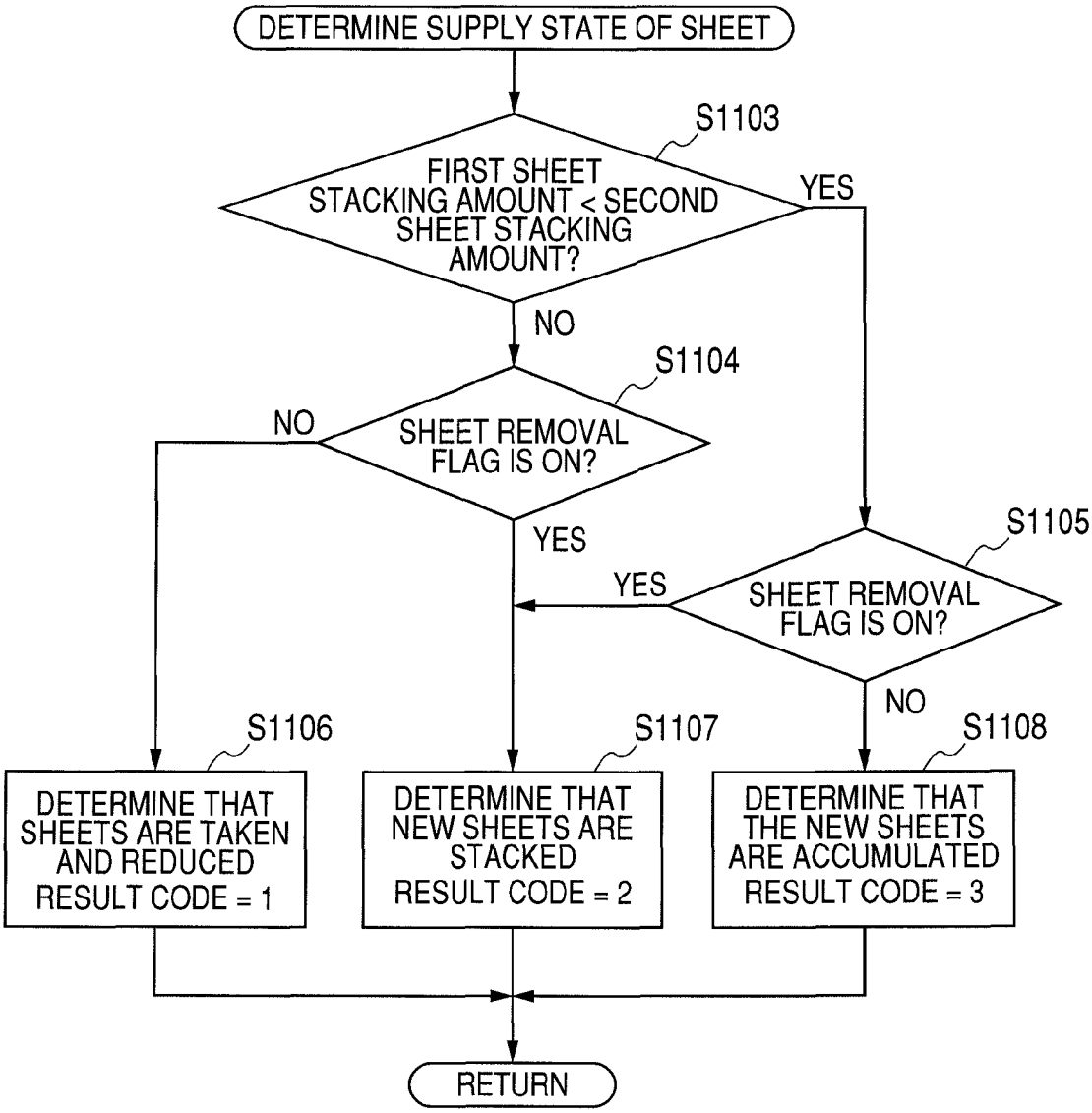
FIG. 10 is a flowchart of determination processing for statuses of the stored sheet when the sheet feeding portion is opened and closed.

FIG. 10 is a flowchart for determining the sheet status. The CPU 301 compares a first stacking amount that represents a stacking amount of the sheets before the sheet feeding portion 133 is opened and a second stacking amount that represents a stacking amount of the sheets after the sheet feeding portion 133 is closed (S1103). Specifically, the CPU 301 determines whether or not the sheets are supplied until the sheet feeding portion 133 is closed after the sheet feeding portion 133 is opened. In the case where the second stacking amount is larger than the first stacking amount, the CPU 301 determines whether or not the sheet removal flag is turned on (S1105). In the case where the sheet removal flag is turned on, the sheets are removed until the sheet feeding portion 133 is closed after the sheet feeding portion 133 is opened. Accordingly, the CPU 301 determines that new sheets are stacked after all of the previously stacked sheets are removed, and sets "2" as a result code (S1107). This result code is stored in the RAM 302. In the case where the sheet removal flag is turned off in S1105, the sheets are not removed until the sheet feeding portion 133 is closed after the sheet feeding portion 133 is opened. Accordingly, the CPU 301 determines that the previously stacked sheets are not removed, and that the new sheets are stacked thereon. Then, the CPU 301 sets "3" as a result code (S1108).

In the case where it is determined in S1103 that the first stacking amount of sheets is larger, the CPU 301 determines whether or not the sheet removal flag is on (S1104). In the case where the sheet removal flag is on (sheets are removed until the sheet feeding portion 133 is closed after the sheet feeding portion 133 is opened), the CPU 301 determines that the new sheets are stacked after all of the previously stacked sheets are removed, and sets "2" as a result code (S1107). In the case where the sheet removal flag is off (sheets are not removed until the sheet feeding portion 133 is closed after the sheet feeding portion 133 is opened) in S1104, the CPU 301 determines that the sheets are taken and reduced, and sets "1" as a result code (S1106).

<Setting of Sheet Type>

Figure 11:
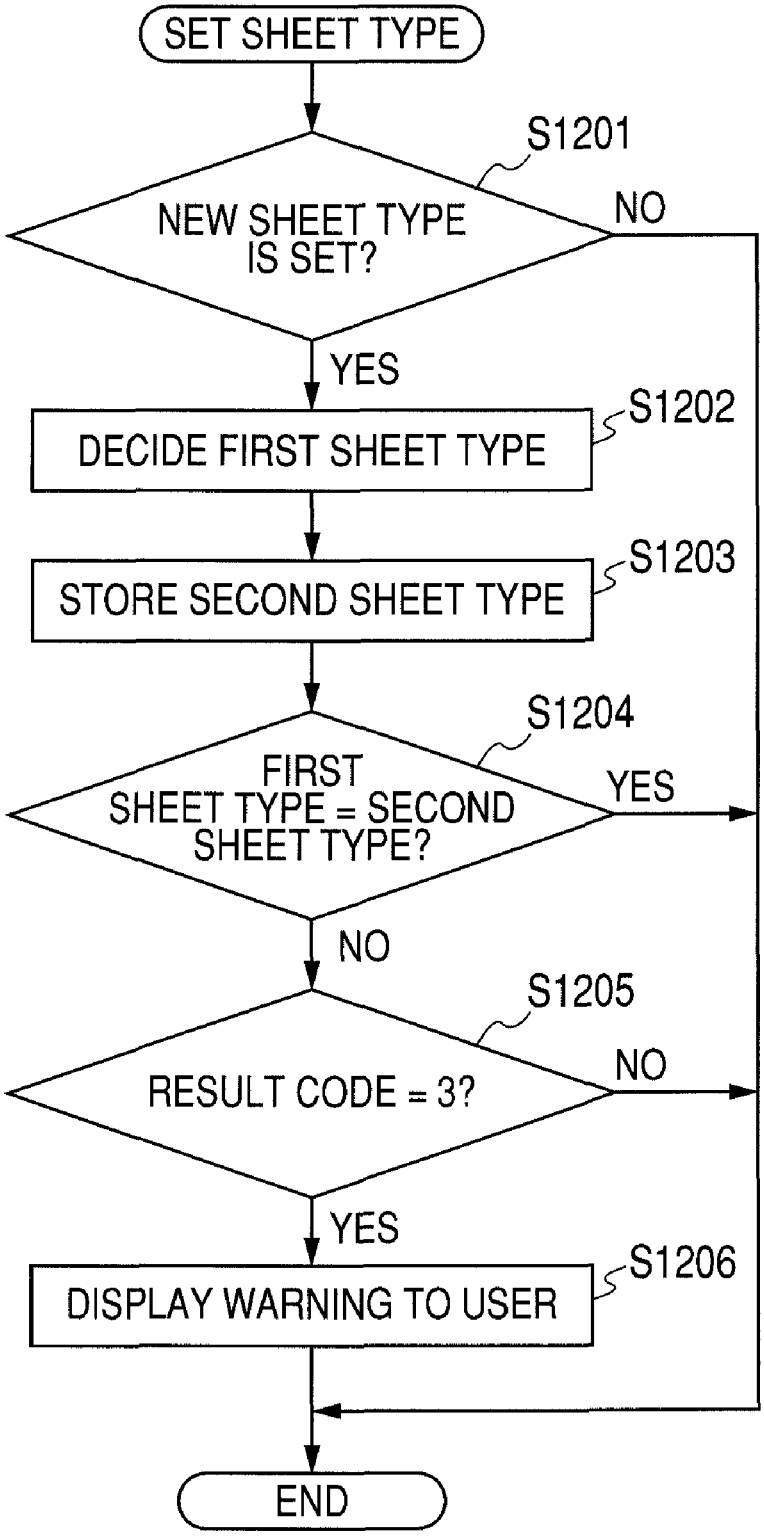
FIG. 11 is a flowchart of processing at the time of setting the sheet type.

FIG. 11 is a flowchart illustrating processing at the time of setting the sheet type by the screen for setting the sheet type illustrated in FIG. 7. Here, it is assumed to set the type of sheets stored in the sheet feeding portion 133. On the setting screen for the sheet type illustrated in FIG. 7, the CPU 301 determines whether or not any one of the sheet types is selected and the OK key 601 is depressed (S1201). When the OK key 601 is depressed, the CPU 301 stores the previously set sheet type as a first sheet type in the RAM 302 (S1202), and stores a newly set sheet type as a second sheet type in the RAM 302 (S1203). The second sheet type is updated as the first sheet type in the case where a sheet type is newly set next time. The CPU 301 determines whether or not the first sheet type and the second sheet type, which are stored in the RAM 302, are the same (S1204). In the case where the first sheet type and the second sheet type are the same, the processing is ended. In the case where the first sheet type and the second sheet type are different from each other, the CPU 301 determines whether or not the result code stored in the RAM 302 is "3" (S1205). In the case where the result code is "3", a different type of sheets are stacked on the sheets already stacked in the sheet feeding portion 133. Accordingly, the CPU 301 issues a warning to this effect to the user (S1206). A screen of this warning is illustrated in FIG. 12.

Figure 12:
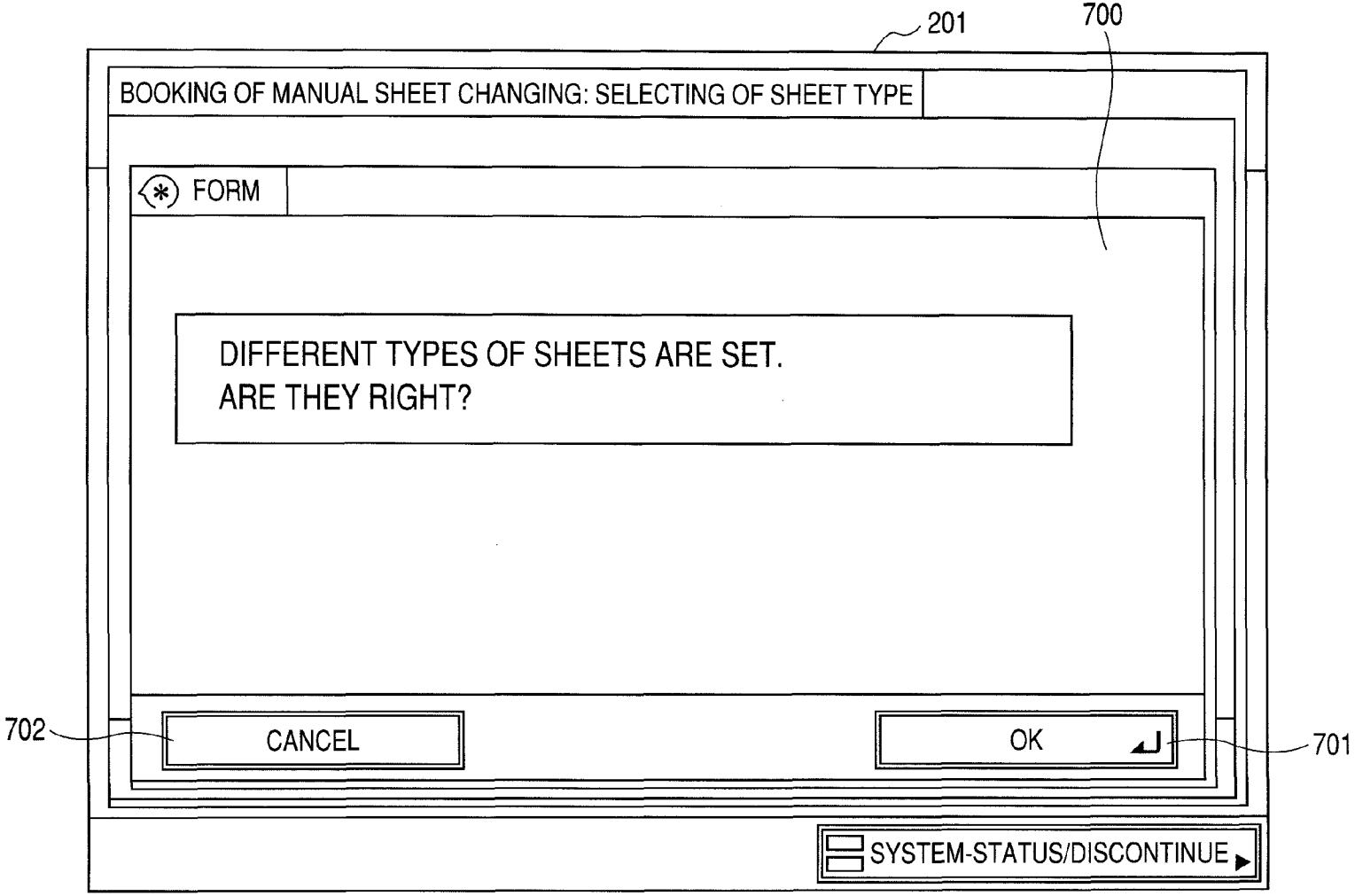
FIG. 12 illustrates a warning screen.
Figure 13:
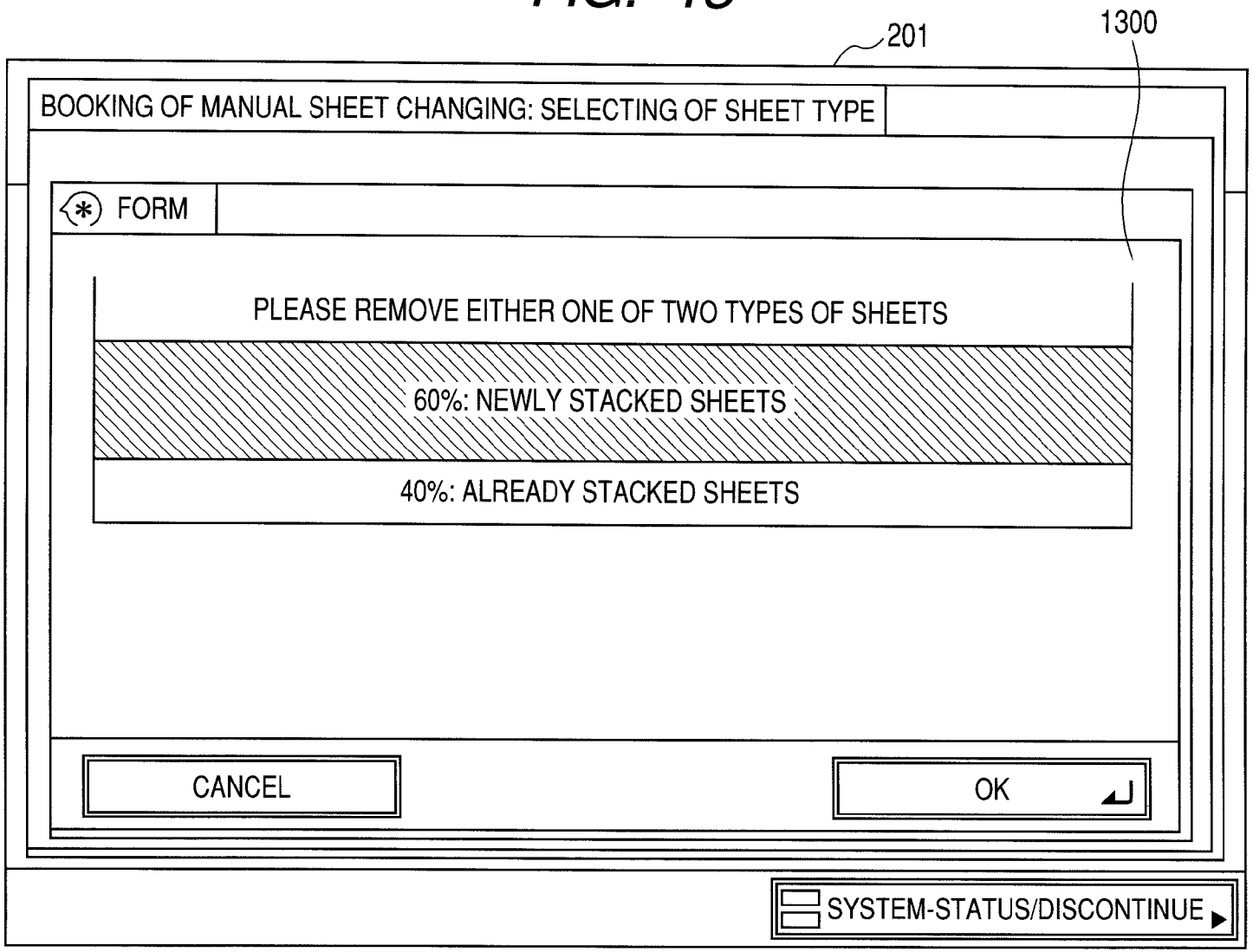
FIG. 13 illustrates another warning screen.

When an OK key 701 is depressed on a warning screen 700 of FIG. 12, setting is made, in which different types of the sheets are mixed in the sheet feeding portion 133. Then, a sheet mixing flag in the RAM 302 is turned on. When a cancel key 702 is depressed, a boundary of the mixed sheets is graphically displayed as illustrated in FIG. 13 based on the first sheet stacking amount and the second sheet stacking amount. Then, a warning 1300 is displayed so as to let the user remove one of the different types of sheets.

The warning screen is displayed to the user, whereby that image forming conditions suitable for the newly stored sheets are applied to the already received sheets can be prevented, and thereby deterioration of image quality can be prevented.

In this embodiment, the sheet type is set from the setting screen of the sheet type, which is illustrated in FIG. 7. However, for example, a configuration may be adopted, in which the sheet type is automatically set by using a bar code reader or a wireless IC tag (RFID tag).

<Case where Sheet Types are Mixed>

Figure 14:
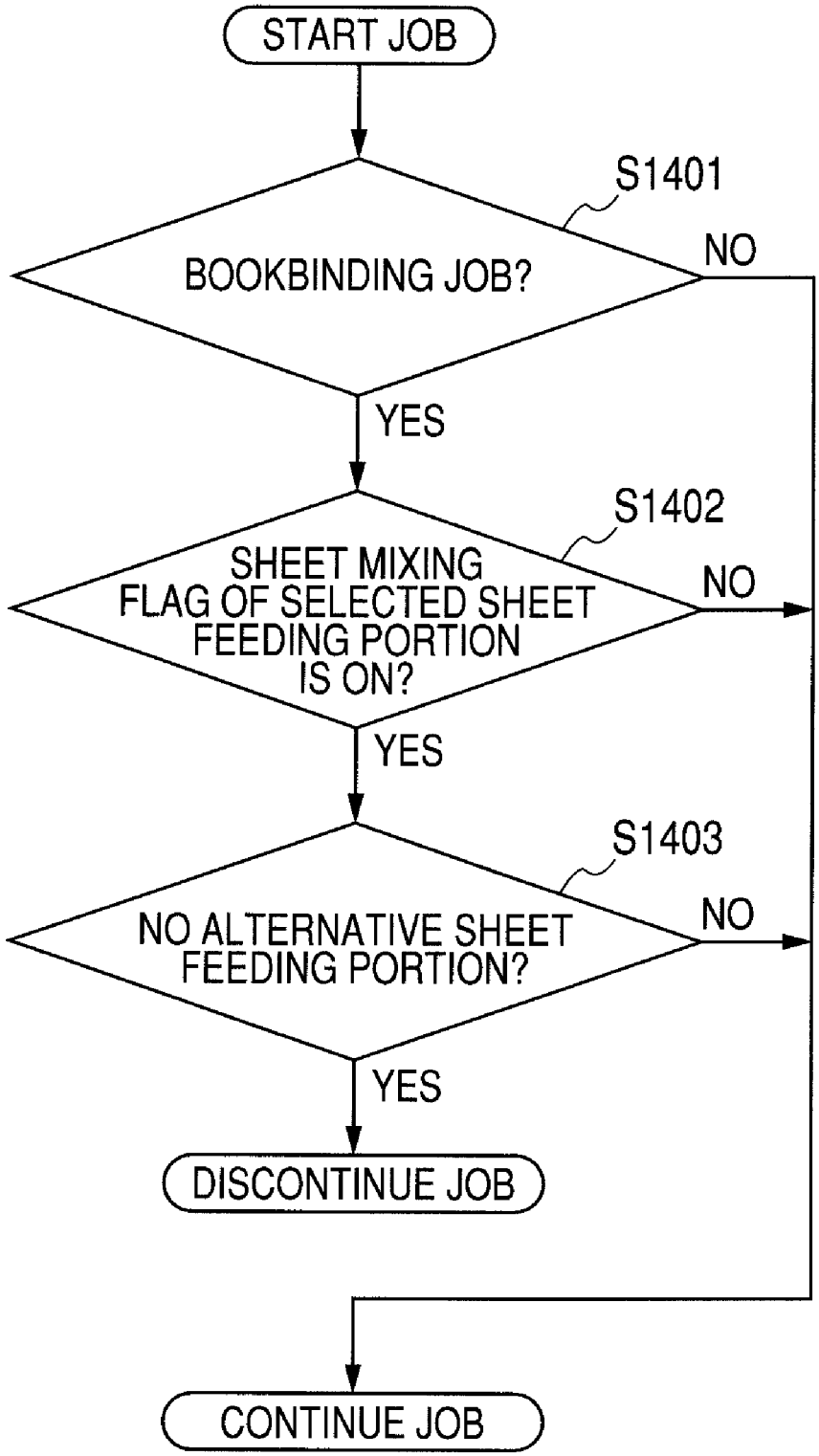
FIG. 14 is a flowchart of determination processing for discontinuance for an image forming job.

Processing of determining discontinuance for an image forming job at the time when the sheet mixing flag is on is described with reference to FIG. 14. A flowchart of FIG. 14 is executed by the CPU 301 based on the program stored in the ROM 303.

The CPU 301 determines whether or not the image forming job to be executed is a job involving bookbinding (S1401). In the case where the job is not involving a bookbinding job, the CPU 301 continues the job. In the case where the job is involving the bookbinding job, the CPU 301 determines whether or not the sheet mixing flag of the designated sheet feeding portion is on (S1402). In the case where the sheet mixing flag is on, it is possible that quality of a book bound article may be lowered. Accordingly, the CPU 301 determines whether or not there is a sheet feeding portion serving as a substitute (S1403). In the case where there is no sheet feeding portion serving as the substitute, the execution of the image forming job is discontinued. The sheet feeding portion serving as the substitute corresponds to a sheet feeding portion, in which the sheet mixing flag is not on, and the same type of sheets, as the type of sheets being set for the selected sheet feeding portion, is stored. In the case where the sheet mixing flag is off, or in the case where the sheet feeding portion serving as the substitute exists even if the sheet mixing flag is on, the CPU 301 continues the image forming job. Specifically, the execution of the bookbinding job using the sheet feeding portion in which the sheet types are mixed is discontinued.

Figure 15:
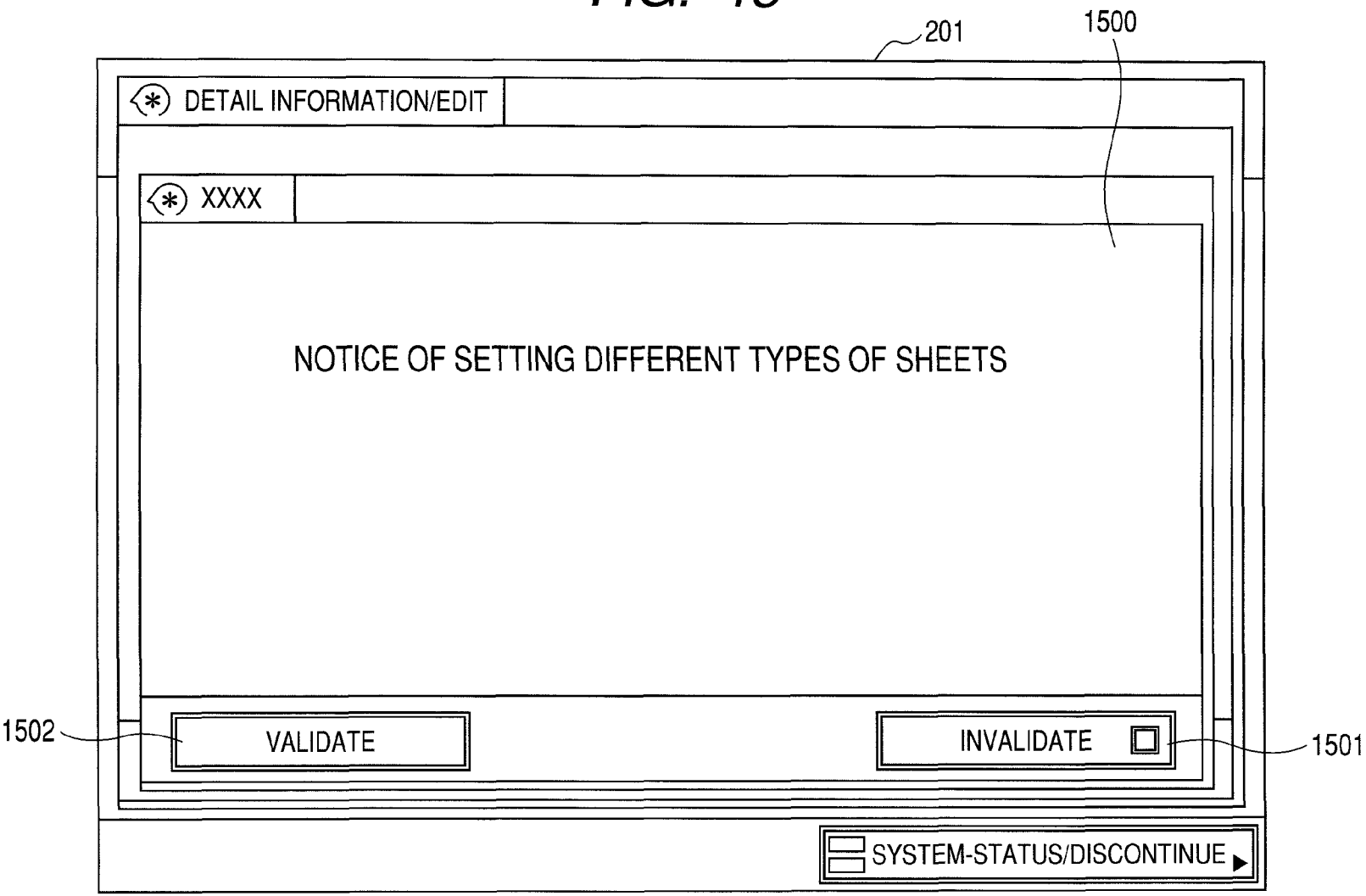
FIG. 15 illustrates a setting screen for automatic display of the warning screen.

Setting as to whether or not to automatically display the warning screen illustrated in FIG. 12 in the case where the different type of sheets is stored on the sheets already stored in the sheet feeding portion may be made in advance. For example, a predetermined key of the display and operation panel 200 is depressed, whereby a setting screen 1500 illustrated in FIG. 15 is displayed. When a key 1501 is depressed, a function to automatically display the warning screen of FIG. 12 is invalidated, and when a key 1502 is depressed, the function to automatically display the warning screen of FIG. 12 is validated. Specifically, the setting screen (including the keys 1501 and 1502) illustrated in FIG. 15 functions as an information setting unit for setting whether or not to automatically display the warning screen.

In the above-mentioned embodiment, the first stacking amount before the sheet feeding portion is opened and the second stacking amount after the sheet feeding portion is opened and closed are compared with each other. However, without using such a comparison result of the stacking amounts of sheets, the warning may be issued in the case where the sheet type is changed though the sheet detecting sensor has not detected absence of the sheets until the sheet feeding portion is closed after the sheet feeding portion is opened.

While the present invention has been described with reference to the exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2008-142837, filed May 30, 2008, which is hereby incorporated by reference herein in its entirety.

What is claimed is:

1. An image forming apparatus comprising:

an informing portion that issues information;

a storing portion that stores sheets;

a sheet detecting portion that detects presence or absence of the sheets in the storing portion;

a determination portion that determines a type of the sheets stored in the storing portion;

an opening/closing detecting portion that detects opening and closing of the storing portion with respect to the image forming apparatus;

a sheet amount detecting portion that detects an amount of the sheets stored in the storing portion; and a control portion that causes the informing portion to issue a predetermined information in a case where the absence of the sheets is undetected by the sheet detecting portion and a change of the type of the sheets is determined by the determination portion;

wherein the control portion causes the informing portion to issue the predetermined information in a case where an amount of the sheets detected by the sheet amount detecting portion after the opening and closing of the storing portion are detected by the opening/closing detecting portion is larger than an amount of the sheets detected by the sheet amount detecting portion before the opening of the storing portion is detected by the opening/closing detecting portion, and the absence of the sheets is not detected by the sheet detecting portion until the closing of the storing portion is detected after the opening of the storing portion is detected.

2. An image forming apparatus according to claim 1, wherein the informing portion displays an instruction of removal of the sheets from the storing portion as the predetermined information.

3. An image forming apparatus according to claim 1, wherein the informing portion displays a boundary position as the predetermined information between sheets stored before the opening of the storing portion and new sheets stored after the opening of the storing portion.

4. An image forming apparatus according to claim 1, wherein, in the case where the absence of the sheets is undetected by the sheet detecting portion and the change of the type of the sheets is determined by the determination portion, the control portion discontinues execution of an image forming job including execution of bookbinding processing using a storing portion in which the type of the sheets is changed.

5. An image forming apparatus comprising:

an informing portion that issues information;

a storing portion that stores sheets;

a sheet detecting portion that detects presence or absence of the sheets in the storing portion;

a determination portion that determines a type of the sheets stored in the storing portion; and a control portion that causes the informing portion to issue a predetermined information in a case where the absence of the sheets is undetected by the sheet detecting portion and a change of the type of the sheets is determined by the determination portion; and an informing setting portion that sets whether the informing portion automatically issues the predetermined information.

6. An image forming apparatus, comprising:

an informing portion that issues information;

a storing portion that is openable and closable with respect to the image forming apparatus, and that stores sheets;

a first detecting portion that detects presence or absence of the sheets in the storing portion;

a determination portion that determines a type of the sheets stored in the storing portion;

a second detecting portion that detects opening and closing of the storing portion;

a control portion that causes the informing portion to issue a warning in a case where a change of the type of the sheets is determined by the determination portion after the opening and closing of the storing portion are detected by the second detecting portion, and the absence of the sheets is undetected by the first detecting portion until the closing of the storing portion is detected after the opening of the storing portion is detected, and in a case where a type of the sheets determined by the determination portion after the opening and closing of the storing portion and a type of the sheets determined before the opening of the storing portion are different from each other; and a warning setting portion that sets whether the informing portion automatically issues the warning.

* * * * *